33-233 SR
2/18/86 XR 4,570,352

United States Patent [19]

Leal

[11] Patent Number: 4,570,352

[45] Date of Patent: Feb. 18, 1986

[54] BOW SIGHT

[76] Inventor: Manuel J. Leal, 62 Liberty St., East Taunton, Mass. 02718

[21] Appl. No.: 767,710

[22] Filed: Aug. 22, 1985

Related U.S. Application Data

[63] Continuation of Ser. No. 561,225, Dec. 14, 1983, abandoned.

[51] Int. Cl.[4] ..... F41G 1/46

[52] U.S. Cl. ..... 33/265; 33/233

[58] Field of Search ..... 33/265, 261, 233; 124/87

[56] References Cited

U.S. PATENT DOCUMENTS

| | | | |
|---|---|---|---|
| 472,069 | 4/1892 | Ord | 33/261 |
| 2,574,599 | 11/1951 | Stieber | 33/265 |
| 2,909,167 | 10/1959 | Fredrickson | 33/265 X |
| 2,970,380 | 2/1961 | Hill | 33/261 |
| 3,499,224 | 3/1970 | Squier et al. | 33/233 |
| 3,648,376 | 3/1972 | Millnamow | 33/265 |
| 3,698,091 | 10/1972 | Merrill et al. | 33/233 |

OTHER PUBLICATIONS

York Archery, Independence, MO 64051, Brochure "Trophy II" Graphite.
Darton Archery Equipment, "SL 3000".
Pro Staff Bows, "2300 Magnum".

*Primary Examiner*—William D. Martin, Jr.
*Attorney, Agent, or Firm*—Kenway & Jenney

[57] ABSTRACT

Bow sight for accurate aiming of an archery bow. The sight includes a mount for supporting a front sight and a rear sight a predetermined distance apart. The front sight has a staircase configuration while the rear sight consists of an opening including cross-hairs. In operation, the cross-hairs of the rear sight are aligned on a target and the bow is elevated to place selected portions of the staircase arrangement of the front sight into alignment with the cross-hairs.

9 Claims, 8 Drawing Figures

BOW SIGHT

This application is a continuation of U.S. patent application Ser. No. 561,225 filed Dec. 14, 1983, now abandoned.

BACKGROUND OF THE INVENTION

This invention relates to archery bow sights. A need exists for a bow sight for improving the accuracy of archery bows used both for target shooting and for hunting. It is therefore an object of this invention to provide a novel bow sight which can dramatically improve shooting accuracy.

It is another object of this invention to provide a bow sight which is highly effective while being of relatively simple construction.

It is yet another object of this invention to provide a bow sight which is inexpensive and easily attached to an archery bow.

SUMMARY OF THE INVENTION

The archery bow sight of this invention includes a rear sight including a frame supporting a pair of cross-hairs, and a front sight including a plurality of locating projections. An elongate mount is provided for supporting the front and rear sights in fixed relation a predetermined distance apart. This mount is adapted for ready attachment to an archery bow. In a preferred embodiment, the locating projections have a staircase configuration. In another embodiment, the locating projections have a sawtooth configuration. It is preferred that the front and rear sights be separated by 10 inches. The preferred front sights include three locating projections. The locating projections compensate for varying distances from the archery bow to the target.

For use with an archery bow having a cable guard, the rear sight is adapted to be attached to the cable guard. The front sight is attached to the bow as in the earlier described embodiment.

BRIEF DESCRIPTION OF THE DRAWING

The invention disclosed herein will be better understood with reference to the drawing in which.

DESCRIPTION OF THE PREFERRED EMBODIMENT

Figure 1:
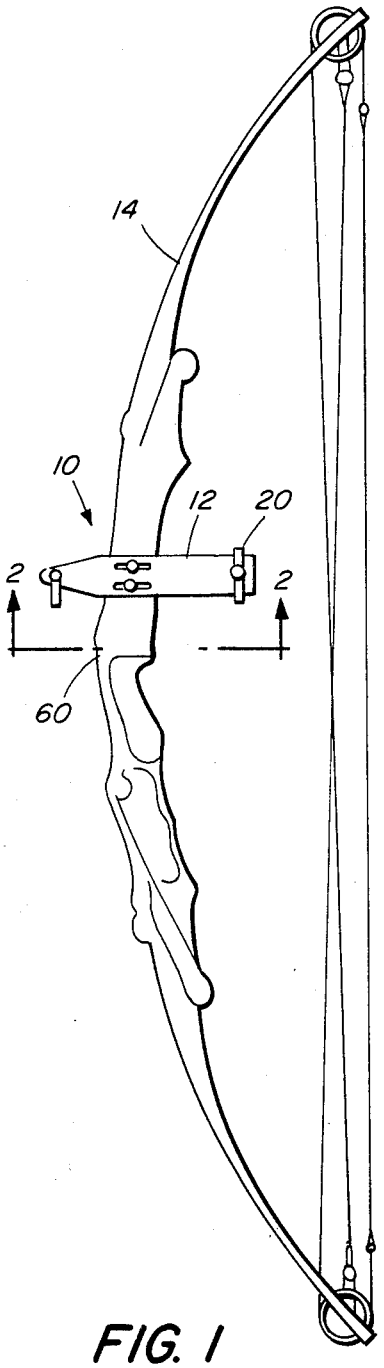
FIG. 1 is a plan view of an archery bow including the bow sight disclosed herein.
Figure 3:
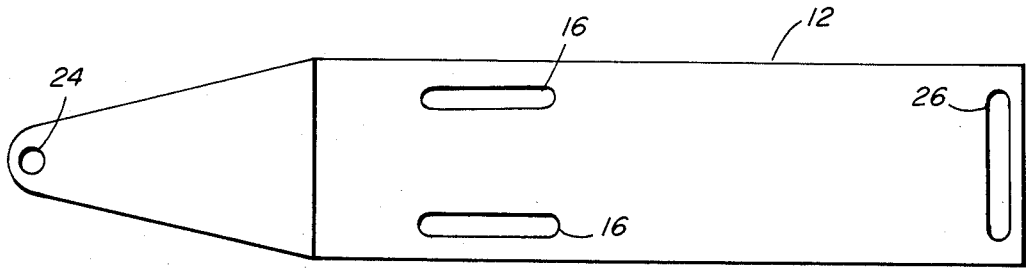
FIG. 3 is a plan view of the bow sight mount of the present invention.
Figure 2:
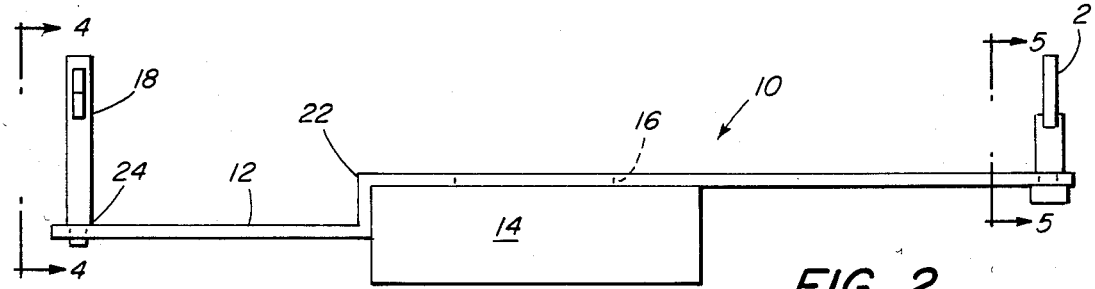
FIG. 2 is a side elevation view of the bow sight disclosed herein.

With reference first to FIGS. 1, 2 and 3, a bow sight 10 includes a mount 12 adapted for attachment to a bow 14 by means of slots 16 in the mount 12. The mount 12 supports a front sight 18 and a rear sight 20. As shown in FIG. 2, the mount 12 has a bend 22 preferably for butting up against the bow 14. The mount 12 is approximately 2 inches wide and includes a threaded hole 24 for attaching the front sight 18, and a slot 26 suitable for attachment of the rear sight 20. The slot 26 is approximately $1\frac{1}{2}$ inches long to permit lateral adjustment of the position of the rear sight 20 within the slot 26. The slots 16 are approximately $1\frac{1}{2}$ inch long permitting adjustment of the location of the mount 12 on the bow 14. The distance between the threaded hole 24 and the slot 26 is 10 inches. Thus, the front sight 18 and the rear sight 20 are maintained separated by 10 inches.

Figure 4:
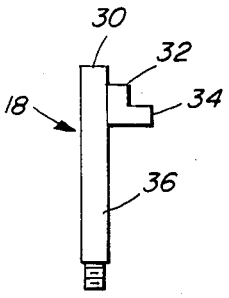
FIG. 4 is a front view of the front sight of FIG. 2.
Figure 5:
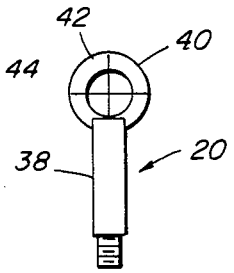
FIG. 5 is a front view of the rear sight shown in FIG. 2.

The front and rear sights will now be described in conjunction with FIGS. 4 and 5. The front sight 18 includes locating projections 30, 32 and 34. The front sight 18 is preferably constructed of $\frac{1}{4}$ inch diameter round metallic stock with threads 36 adapted for attaching to the mount 12 at the threaded hole 24. The "steps" of the staircase arrangement of the locating projections 30, 32 and 34 are approximately $\frac{1}{4}$ of an inch in height. The rear sight 20 includes a threaded post 38, preferaly $\frac{1}{4}$ inch in diameter. The post 38 supports an annulus 40, the central hole of which is approximately $\frac{5}{8}$ of an inch in diameter. The annulus 40 includes cross-hairs 42 and 44 preferably made of copper wire having a diameter of 0.020 inch.

Figure 6:
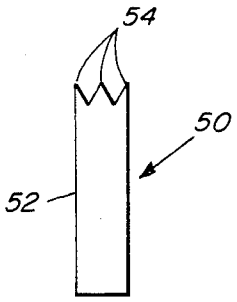
FIG. 6 is an alternate configuration of a front sight.

An alternative to the staircase configuration of the front sight 18 is shown in FIG. 6. This alternative front sight 50 includes a threaded cylindrical post 52 with sawtooth projections 54 at its end. The sawtooth projections 54 are approximately $\frac{1}{8}$ inch apart.

Figure 8:
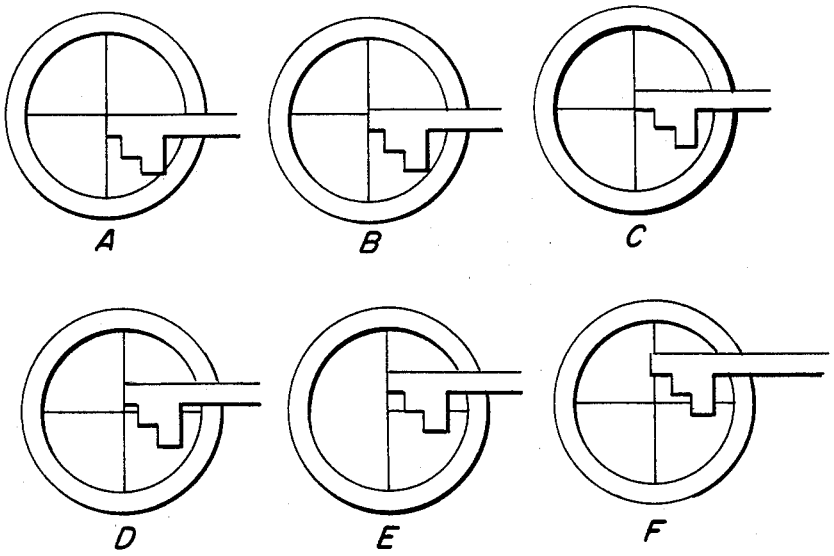
FIG. 8(*a*) through 8(*f*) illustrate the view seen through the bow sight of this invention.

The operation of the bow sight 10 will now be described in conjunction with FIG. 8. To aim a bow having the bow sight 10 disclosed herein, the cross-hairs of the rear sight 20 are aligned on the target. The bow is then elevated to align the appropriate one of the locating projections with the crosshairs. As shown in FIG. 8(*a*), the bow is aimed so that the edge of the projection 30 is aligned with the cross-hairs. This alignment will provide accurate shooting for targets 0 to 10 yards from the archer. Once the bow is sighted-in from zero to ten yards, it is automatically sighted-in for the other yardages. FIG. 8(*b*) shows the view through the bow sight 10 when the target is approximately 20 yards away. Notice that the bow has been elevated so that the cross-hair now intersects the middle of the projection 30. Similarly, FIG. 8(*c*) shows the view through the bow sight 10 when the target is approximately 30 yards distant. Similarly, FIGS. 8(*d*), (*e*) and (*f*) illustrate the view through the bow sight 10 for targets 40, 50 and 60 yards away respectively. It will be apparent that the sawtooth arrangement of the front sight 50 can be used in a similar fashion. The sharp points 54 make sighting easier to a finer point which is particularly advantageous when hunting small or large game.

The bow sight 10 disclosed herein is mounted on a bow so as to allow a space of approximately 3 inches between the rear sight 20 and the bow string of the bow 14. The mount 12 is affixed to the bow so that the distance from the arrow to the front sight will be $\frac{1}{4}$ to $\frac{1}{2}$ inch less than the distance from the arrow to the rear sight when the arrow is in shooting position. Fine adjustments can be made by moving the rear sight 20 within the slot 26 in the mount 12. The front sight can also be adjusted for windage and the rear sight adjusted for windage and elevation.

Figure 7:
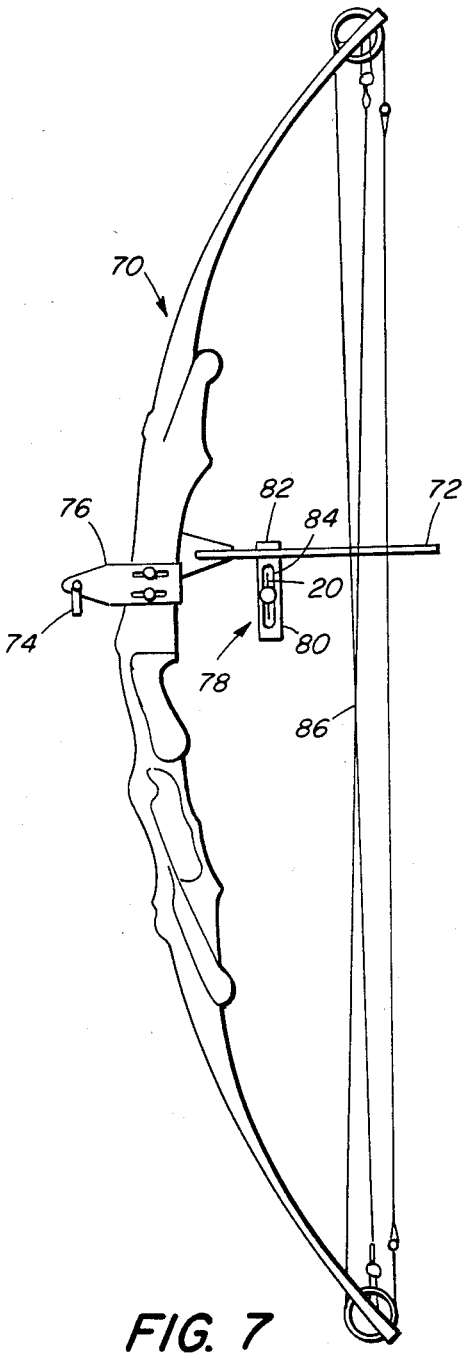
FIG. 7 is a plan view of a bow including a cable guard and a bow sight as disclosed herein.

With reference now to FIG. 7, a bow 70 includes a cable guard 72. In this case, the bow sight of this invention is in two pieces. A front sight 74 is supported on a mount 76 similar to the forward portion of the mount 12 shown in FIG. 1. In this case, a rear sight 78 is mounted on the cable guard 72 itself. The rear sight 78 includes a mounting member 80 adapted to slide over the cable guard 72 and to be locked in place by means of a locking screw 82. The member 80 includes a slot 84 in which the rear sight 20 shown in FIG. 5 may be securely affixed. As with the earlier described embodiment, the front sight 74 and rear sight 78 are maintained 10 inches apart and a 3 inch space is maintained between the rear sight 78 and a bow string 86 of the bow 70. The separation will prevent the bow string 86 from fraying through contact with the rear sight 78. As with the earlier described embodiment, the bow 70 is aimed by aligning the cross-hairs of the rear sight 78 with a target and then elevating the bow 70 so that the appropriate staircase or sawtooth is aligned with the cross-hair to provide accuracy for a particular target distance.

It is thus seen that the objects of this invention have been achieved in that there has been disclosed a bow sight for very accurately aiming a archery bow which accurately compensates for varying distances to a target. Overdraw or underdraw of the string of a compound bow will not affect accuracy. The bow sight is of simple construction and readily attaches to archery bows. It is recognized that modifications and variations of the bow sight disclosed herein will occur to those skilled in the art and it is intended that all such modifications and variations be included within the scope of the appended claims.

What is claimed is:

1. Archery bow sight to compensate for range variations to a target comprising:

an elongate mount having a major axis attached to the archery bow, the mount including front and rear sight attachment points separated by predetermined, fixed distance along the major axis;

a rear sight attached to the rear sight attachment point on said mount and extending upwardly from the mount, the rear sight including a frame supporting a pair of cross-hairs; and a front sight attached to the front sight attachment point on said mount and extending upwardly from the mount, the front sight terminating in a plurality of locating projections spaced apart in a direction transverse to the major axis of the mount, whereby the cross-hairs are aligned with one of the locating projections on the front sight according to the range to the target.

2. The bow sight of claim 1 wherein said locating projections have a staircase configuration.

3. The bow sight of claim 1 wherein said locating projections have a sawtooth configuration.

4. The bow sight of claim 1 wherein said front sight and said rear sight are separated by 10 inches.

5. The bow sight of claim 2 wherein said staircase configuration includes projections.

6. The bow sight of claim 3 wherein said sawtooth configuration includes three projections.

7. The archery bow sight of claim 1 for use with a bow including a cable guard wherein the mount has a two-piece construction and the rear sight is attached to the cable guard.

8. The bow sight of claim 7 wherein said locating projections have a staircase configuration.

9. The bow sight of claim 7 wherein said locating projections have a sawtooth configuration.

* * * * *